US008866695B2

(12) United States Patent
Renilson et al.

(10) Patent No.: US 8,866,695 B2
(45) Date of Patent: Oct. 21, 2014

(54) ALIGNMENT STABLE ADJUSTABLE ANTENNA MOUNT

(75) Inventors: Ian Thomas Renilson, Dalgety Bay (GB); Matthew R Lewry, Limekilns (GB); James Michael Jefferson, Glenrothes (GB)

(73) Assignee: Andrew LLC, Hickory, NC (US)

( * ) Notice: Subject to any disclaimer, the term of this patent is extended or adjusted under 35 U.S.C. 154(b) by 26 days.

(21) Appl. No.: 13/403,174

(22) Filed: Feb. 23, 2012

(65) Prior Publication Data

US 2013/0221182 A1 Aug. 29, 2013

(51) Int. Cl.
*H01Q 1/12* (2006.01)
*H01Q 3/02* (2006.01)

(52) U.S. Cl.
CPC ..... *H01Q 1/125* (2013.01); *H01Q 3/02* (2013.01); *H01Q 1/1228* (2013.01)
USPC ..... 343/882; 343/892; 248/218.4

(58) Field of Classification Search
CPC ... H01Q 1/1228; H01Q 1/125; H01Q 1/1264; H01Q 3/02
USPC ..... 248/274.1, 276.1, 282.1, 283.1, 284.1, 248/534, 535, 536, 218.4; 343/878, 880, 343/882, 892, 890
See application file for complete search history.

(56) References Cited

U.S. PATENT DOCUMENTS 4,074,271 A * 2/1978 Sakuma ..... 343/882
4,360,182 A * 11/1982 Titus ..... 248/371
4,460,294 A 7/1984 Cobb et al.
4,800,394 A 1/1989 Homann et al.
4,819,007 A 4/1989 Tezcan
5,508,712 A 4/1996 Tom et al.
5,835,068 A 11/1998 Paul et al.
5,867,132 A 2/1999 Blasing et al.
6,031,508 A 2/2000 Ishizuka et al.
6,189,873 B1 2/2001 Aoki
6,262,691 B1 7/2001 Austin et al.
6,342,870 B1 * 1/2002 Mehrkens et al. ..... 343/891
6,404,400 B1 6/2002 Tulloch
6,407,713 B1 6/2002 Mallenius
6,452,567 B1 * 9/2002 Overton ..... 343/891
6,474,614 B2 * 11/2002 MacEachern ..... 248/349.1
6,512,492 B2 1/2003 Overton (Continued)

FOREIGN PATENT DOCUMENTS

GB 2120856 12/1983
WO WO96/39726 12/1996

OTHER PUBLICATIONS

Sung Chul Kang, International Search Report of Counterpart International Application No. PCT/US12/66507, Mar. 18, 2013, Daejeon Metropolitan City, Korea.

*Primary Examiner* — Jonathan Liu
*Assistant Examiner* — Guang H Guan
(74) *Attorney, Agent, or Firm* — Babcock IP, PLLC

(57) ABSTRACT

An antenna mount is provided with a pivot base and a pivot saddle rotatably coupled to the pivot base by a pivot connection and at least one pivot arm connection. The pivot connection is provided with dual opposing conical countersunk head pivot connection bolts seated within conical countersunk pivot connection bolt holes of the pivot saddle, the conical countersunk head pivot connection bolts extending through the conical countersunk pivot connection bolt holes of the pivot saddle to couple with the pivot base about a pivot axis.

13 Claims, 7 Drawing Sheets

(56) References Cited

U.S. PATENT DOCUMENTS

| | | | | |
|---|---|---|---|---|
| 6,559,805 | B2 * | 5/2003 | Yamauchi et al. | 343/766 |
| 6,657,598 | B2 | 12/2003 | Tulloch | |
| 6,664,937 | B2 * | 12/2003 | Vermette et al. | 343/892 |
| 6,963,316 | B1 * | 11/2005 | Lin | 343/882 |
| 7,046,210 | B1 | 5/2006 | Brooker et al. | |
| 7,142,168 | B1 | 11/2006 | Sinclair | |
| 7,173,575 | B2 | 2/2007 | Brooker | |
| 7,374,137 | B2 * | 5/2008 | Staney | 248/122.1 |
| 7,432,875 | B1 * | 10/2008 | Sergi | 343/890 |
| 7,439,930 | B2 | 10/2008 | Bury | |
| 7,513,474 | B2 | 4/2009 | Anderson et al. | |
| 7,518,569 | B1 * | 4/2009 | Conrad | 343/882 |
| 7,954,777 | B2 | 6/2011 | Bohm et al. | |
| 2008/0083865 | A1 * | 4/2008 | Matsui | 248/496 |
| 2008/0150831 | A1 | 6/2008 | Tulloch | |
| 2010/0084521 | A1 * | 4/2010 | Cases | 248/121 |
| 2011/0074652 | A1 | 3/2011 | Lewry et al. | |
| 2012/0119973 | A1 * | 5/2012 | Ahring et al. | 343/882 |

* cited by examiner

Fg 3

ALIGNMENT STABLE ADJUSTABLE ANTENNA MOUNT

BACKGROUND

1. Field of the Invention

This invention relates to reflector antennas. More particularly, the invention relates to a cost efficient adjustable antenna mount with improved alignment stability.

2. Description of Related Art

Reflector antennas, for example terrestrial microwave reflector antennas, may be highly directional. To maximize electrical performance, the antenna mount of a reflector antenna may be finely adjustable for ease of obtaining a boresight alignment between antenna pairs forming an RF communications link. The antenna mount should maintain the selected alignment despite exposure over time to wind and/or ice loads acting upon the reflector antenna that, depending upon the installation location, may rise to extreme levels during short periods such as storms. As a distance to the target antenna increases, even very small alignment shifts become significant. Should the antenna mount lose the desired boresight alignment, for example due to transient wind and/or ice loads, a significant expense may be incurred to return to a remote location such as atop a radio tower and repeat the alignment procedure.

Antenna mount ease of alignment adjustment and alignment stability characteristics may be improved in a trade-off with manufacturing cost and dimensional characteristics of the resulting antenna mount.

Competition in the antenna mount market has focused attention on improving alignment stability and ease of alignment adjustment while also minimizing overall manufacturing, inventory, distribution, installation and maintenance costs. Therefore, it is an object of the invention to provide a reflector antenna mount that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have discovered that a significant factor for alignment stability of an antenna mount is the lateral fit tolerances in the antenna mount between fasteners such as threaded bolts and their associated bolt holes. The inventors' testing has demonstrated that these fit tolerances can be a factor in permanent misalignment after simulated transient wind and/or ice loads are applied.

Figure 1:
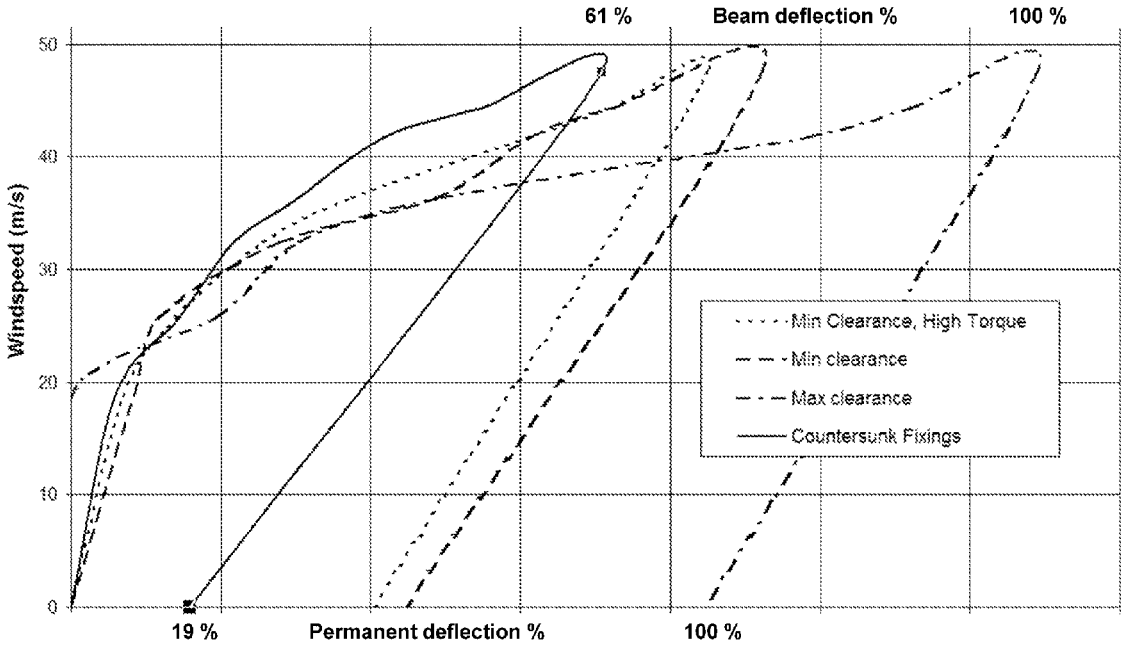
FIG. 1 is a chart comparing actual test data of antenna mounts measuring angular deflection when pivot connection bolts and holes of varying tolerance and tightening torque are subjected to simulated wind loads.
Figure 2:
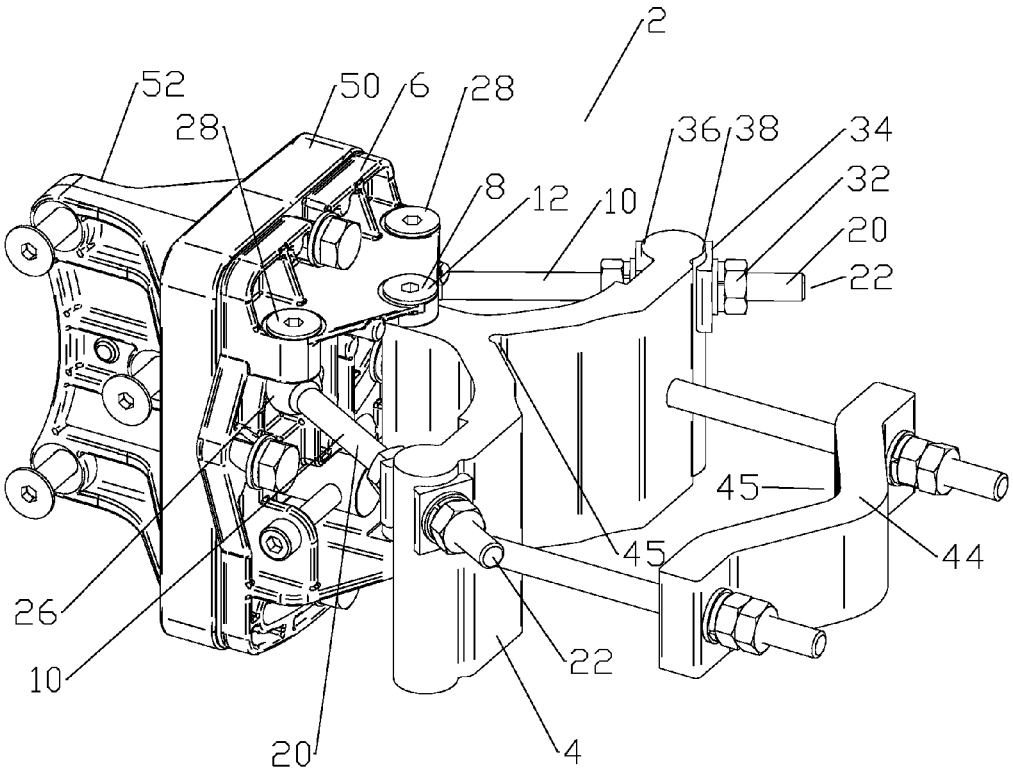
FIG. 2 is a schematic isometric back view of an exemplary antenna mount.

FIG. 1 shows the inventor's test data of changes in antenna mount angular alignment from an initial position as progressive levels of simulated windloading are applied and subsequently removed. Testing was performed upon embodiments of the same antenna mount configuration modeling pivot connection bolts and holes with maximum clearance, minimum clearance, minimum clearance with high torque and countersunk fixings (conical countersunk bolt heads and matching countersink bolt holes) with otherwise maximum clearance. Clearance is the amount of room between the unthreaded portion of the bolt shaft and the surrounding bolt hole, with maximum clearance enabling ready insertion of the bolt into the hole and minimum clearance requiring close alignment prior to insertion.

The test data demonstrates that, even where tolerances are increased by applying significantly higher manufacturing precision and/or fastening torque, significant deflection and permanent misalignment result when simulated wind loads are applied to conventional bolt and hole interconnections. However, the self-aligning characteristic of a conical countersunk bolt head seating within a corresponding countersunk bolt hole produces significantly higher alignment stability (39% improvement) and reduces permanent misalignment due to transient wind loads (81% improvement). Thereby, the countersunk bolt and hole antenna mount improves alignment stability without the additional expense of increased manufacturing precision or the problems related to applying high torque levels to the interconnections.

Figure 3:
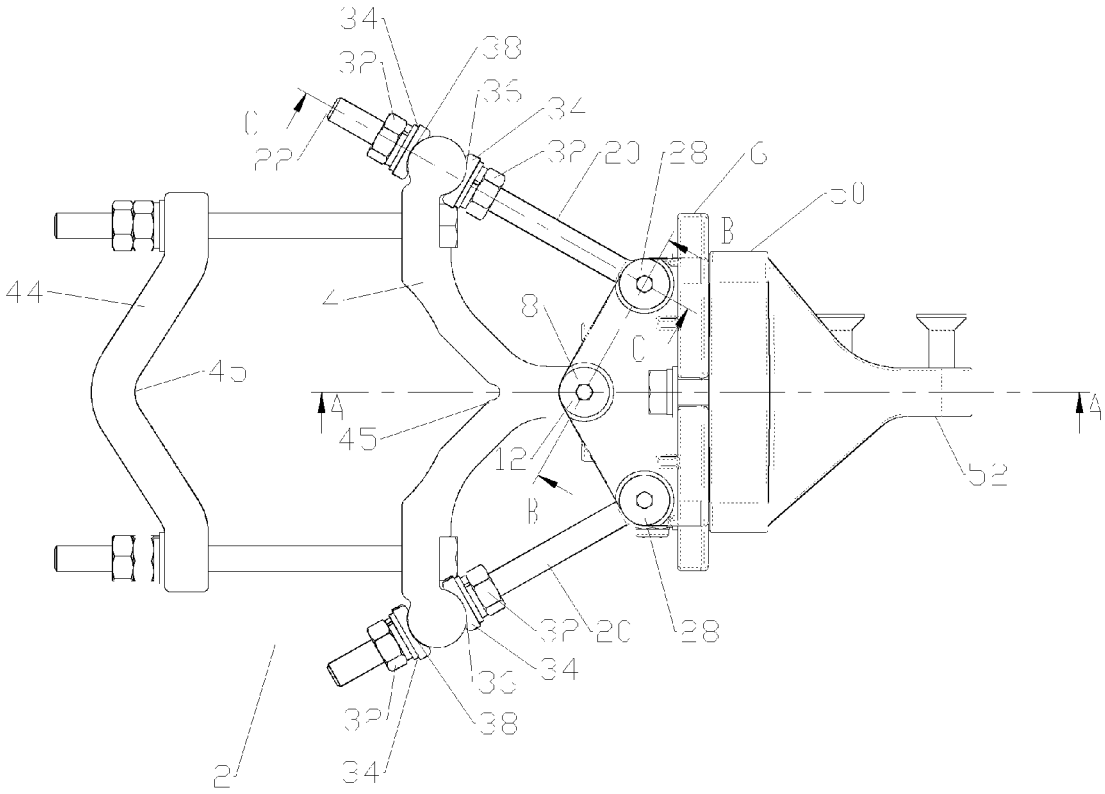
FIG. 3 is a schematic top view of the antenna mount of FIG. 2.
Figure 4:
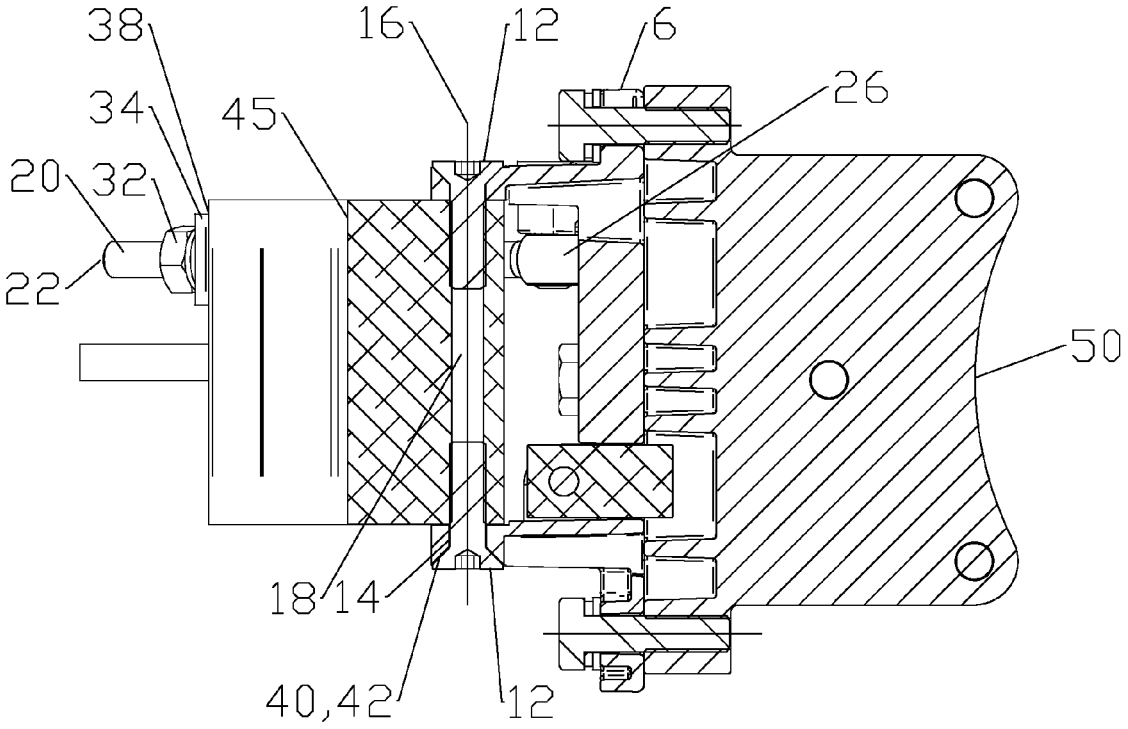
FIG. 4 is a schematic cut-away view of the antenna mount of FIG. 3, taken along line A-A.

An exemplary embodiment of an antenna mount 2 utilizing conical countersunk bolt head fastening with respect to azimuth alignment fasteners is shown in FIGS. 2-6. A pivot base 4 is coupled to a pivot saddle 6 by a pivot connection 8 and at least one pivot arm connection 10. As best shown in FIG. 4, the pivot connection 8 utilizes dual opposing conical countersunk head pivot connection bolts 12 seated within conical countersunk pivot connection bolt holes 14 of the pivot saddle 6, the conical countersunk head pivot connection bolts 12 extending through the conical countersunk pivot connection bolt holes 14 of the pivot saddle 6 to couple with the pivot base 4 along a pivot axis 16. Thereby, the pivot saddle 6 may pivot with respect to the pivot base 4, about the pivot axis 16.

The dual opposing conical countersunk head pivot connection bolts 12 extend through the conical countersunk pivot connection bolt holes 14 to couple with the pivot base 4, for example at a pivot connection hole 18 extending through the pivot base 4 or alternatively into individual pivot connection holes dedicated to each conical countersunk head pivot connection bolt 12. One skilled in the art will appreciate that utilizing a single pivot connection hole 18 ensures alignment of each conical countersunk head pivot connection bolt 12 with the pivot axis 16. A single pivot connection hole 18 may be partially threaded from each end, so that reverse threading is not required for assembly/adjustment of the pivot connection 8.

Although demonstrated with two pivot arm connections 10, one on either side of the pivot connection 8 for increased strength, one skilled in the art will appreciate that, depending upon the desired characteristics of the antenna mount 2, intended antenna and/or antenna mounting environment, only a single pivot arm 10 connection may be required.

Figure 5:
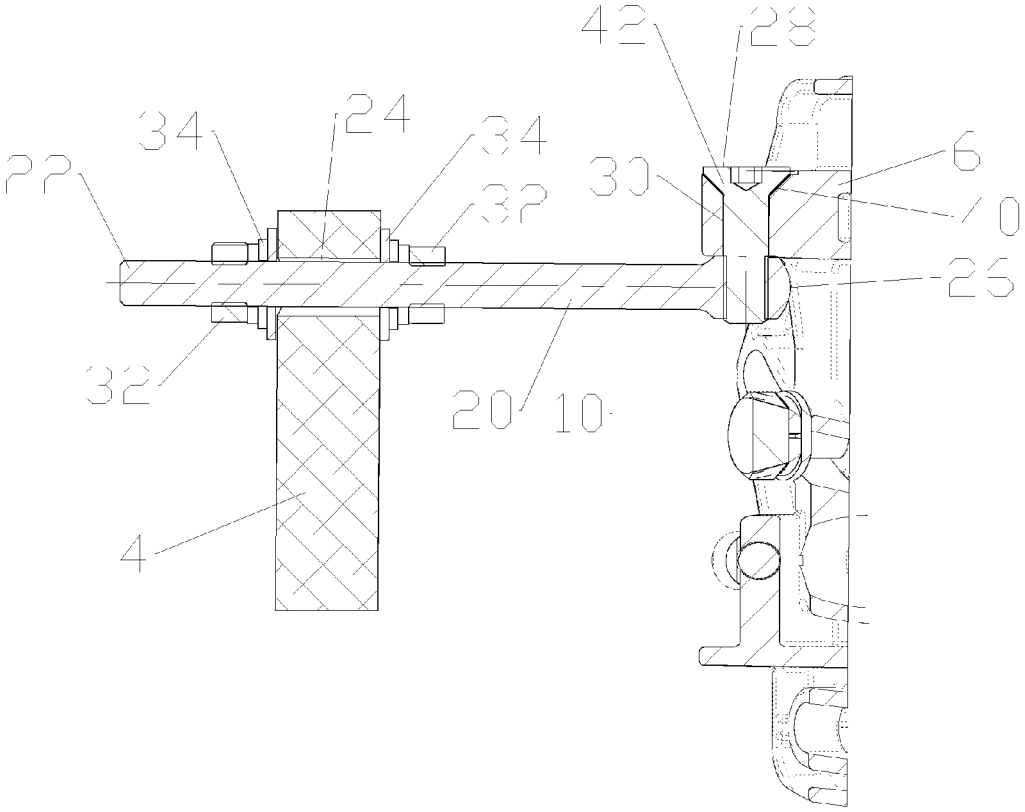
FIG. 5 is a schematic cut-away view of the antenna mount of FIG. 3, taken along line C-C.

The pivot arm connection 10 is demonstrated as an extension bolt 20 extending between the pivot base 4 and the pivot saddle 6. As best shown in FIG. 5, a first end 22 of the extension bolt 20 passes through a pivot slot 24 of the pivot base 4 and a second end 26 of the extension bolt 20 is coupled to the pivot saddle 6 by a conical countersunk head pivot arm bolt 28 extending through a conical countersunk pivot arm bolt hole 30 of the pivot saddle 6. The pivot slot 24 is dimensioned to enable the desired angular travel of the extension bolt 20 with respect to the pivot base 4 as the pivot saddle 6 pivots through its intended range of motion.

Figure 6:
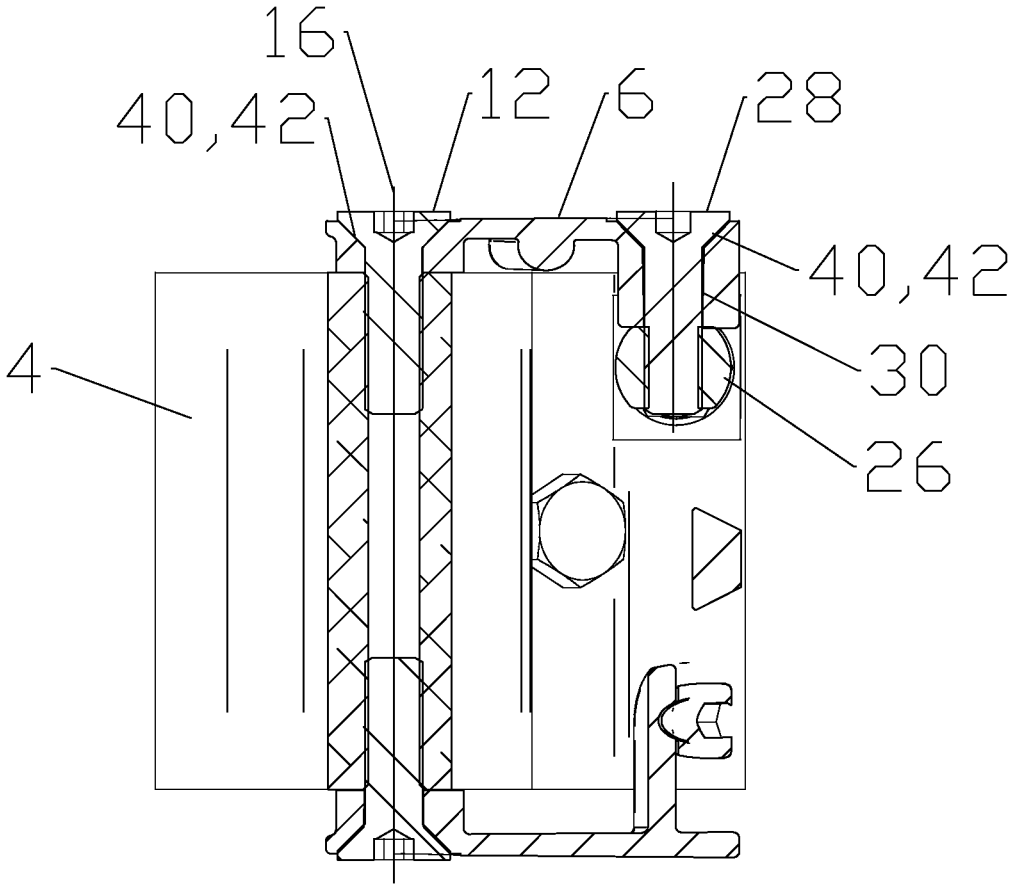
FIG. 6 is a schematic cut-away view of the antenna mount of FIG. 3, taken along line B-B.

As best shown in FIG. 6, the conical countersunk head pivot arm bolt 28 is aligned parallel to the pivot axis 16. Thereby, the pivot saddle 6 is pivoted about the pivot connection 8 according to a length of the extension bolt 20 as the extension bolt 20 is extended or shortened by adjusting nuts 32 abutting the pivot slot 24 along the length of the extension bolt 20.

The pivot saddle 6 may be provided with a partially circular cross section, proximate the pivot slot 24, along the pivot axis 16 (see FIG. 3). Washers 34 with a corresponding circle arc segment face may be provided seated against this partially circular cross section on a front side 36 and a back side 38 of the pivot slot 24. Thereby, a close connection by the nuts 32 of extension bolt 20 to the pivot base 4 can be ensured throughout the entire angular range of motion of the extension bolt 20.

The conical countersunk pivot arm bolt hole 14 and the conical countersunk pivot connection bolt hole(s) 30 may be provided in the pivot saddle 6 with each of the corresponding countersinks 40 aligned within a common plane.

To ensure that the countersunk pivot connection bolt holes 14 and conical countersunk pivot arm bolt holes 30 mesh with the corresponding heads of the countersunk pivot connection bolts 12 and conical countersunk pivot arm bolts 28 in a self centering alignment, each of the bolt heads 42 may be provided with a cone angle generally equal to a cone angle of the corresponding countersink 40, as best demonstrated in FIGS. 4-6.

Figure 7:
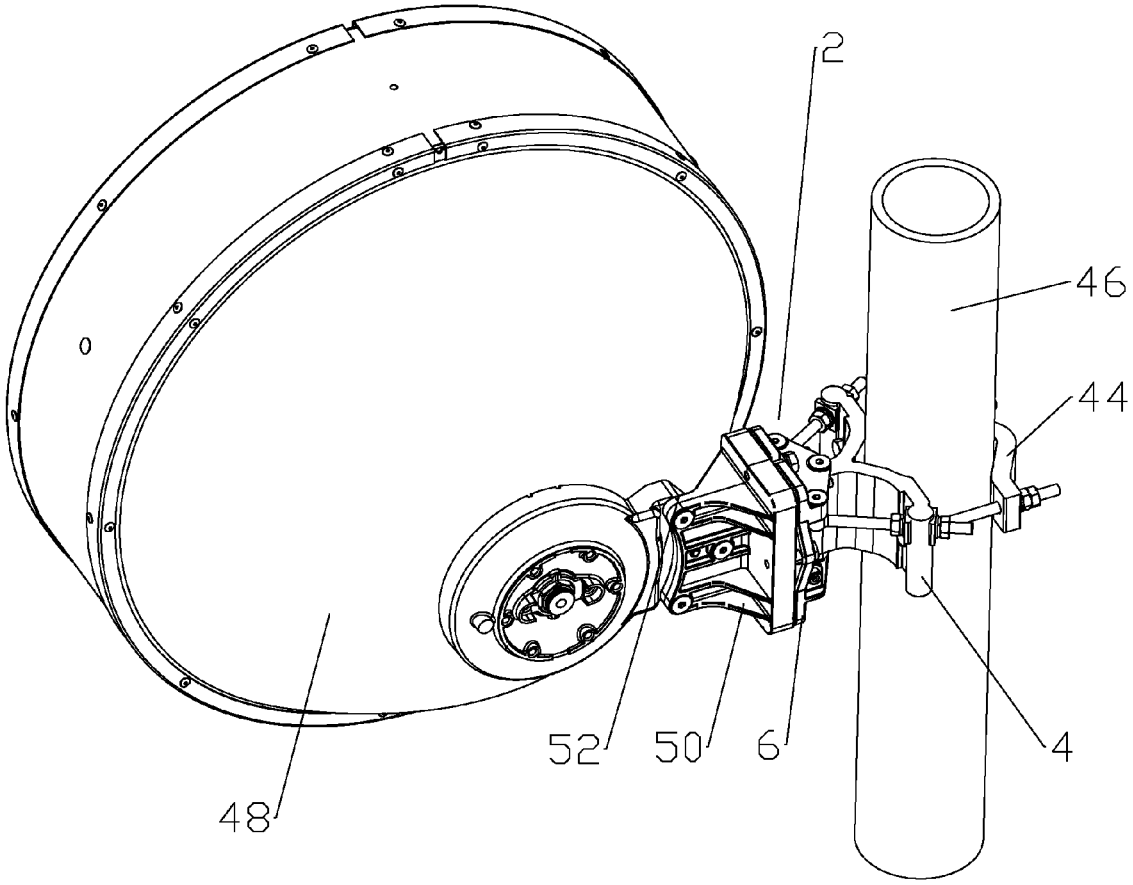
FIG. 7 is a schematic isometric view of the antenna mount of FIG. 2, demonstrated

A mounting bracket 44 coupled to the pivot base 4 may be provided with mounting grooves 45 aligned parallel to the pivot axis 16, enabling ready alignment of the antenna mount 2 and thereby an attached reflector antenna 48 with vertical and horizontal adjustment axes when the mounting bracket and thereby the antenna mount is attached to a vertical surface, such as a pole 46 or tower leg, for example as shown in FIG. 7.

Further adjustability of the antenna mount 2 may be provided by an elevation plate 50 coupled to the pivot saddle 6 with a range of angular movement in the vertical axis. The elevation plate 50 may be provided with an antenna mounting surface 52 upon which the, for example, desired reflector antenna 48 is rigidly mounted.

One skilled in the art will appreciate that the pivot base 4 and/or pivot saddle 6 may be cost efficiently manufactured via die casting from metal material. Further, the pivot base 4 and/or mounting bracket 44 may be formed as an extrusion that is then cut to length and necessary holes bored/threaded.

One skilled in the art will appreciate that the self alignment characteristic of the conical countersunk-type bolt head within a corresponding conical countersunk bolt hole eliminates the need for providing an expensive to manufacture and difficult to assemble high precision fit between a traditional bolt and bolt hole where an interconnection without the possibility of a lateral shift is desired. By providing each of the bolt into hole connections that are parallel with the pivot axis 16 as conical countersunk bolt heads within a corresponding conical countersunk bolt hole connections, a significant improvement in alignment stability of the resulting antenna mount 2 may be demonstrated. Further, the solution may exhibit higher alignment stability than the prior practice of simply increasing interconnection torque levels, which may damage the assembly and/or inhibit ready re-alignment of the antenna mount 2.

Table of Parts

| | |
|---|---|
| 2 | antenna mount |
| 4 | pivot base |
| 6 | pivot saddle |
| 8 | pivot connection |
| 10 | pivot arm connection |
| 12 | conical countersunk head pivot connection bolt |
| 14 | conical countersunk pivot connection bolt hole |
| 16 | pivot axis |
| 18 | pivot connection hole |
| 20 | extension bolt |
| 22 | first end |
| 24 | pivot slot |
| 26 | second end |
| 28 | conical countersunk head pivot arm bolt |
| 30 | conical countersunk pivot arm bolt hole |
| 32 | nut |
| 34 | washer |
| 36 | front side |
| 38 | back side |
| 40 | countersink |
| 42 | bolt head |
| 44 | mounting bracket |
| 45 | mounting groove |
| 46 | pole |
| 48 | reflector antenna |
| 50 | elevation plate |
| 52 | antenna mounting surface |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An antenna mount, comprising:

a pivot base;

a pivot saddle rotatably coupled to the pivot base by a pivot connection and at least one pivot arm connection;

the pivot connection provided with dual opposing conical countersunk head pivot connection bolts seated within conical countersunk pivot connection bolt holes of the pivot saddle, the conical countersunk head pivot connection bolts extending through the conical countersunk pivot connection bolt holes of the pivot saddle to couple with the pivot base about a pivot axis;

the at least one pivot arm connection is an extension bolt extending between the pivot base and the pivot saddle; a first end of the extension bolt passing through a pivot slot of the pivot base; a second end of the extension bolt coupled to the pivot saddle by a conical countersunk head pivot arm bolt extending through a conical countersunk pivot arm bolt hole of the pivot saddle; the conical countersunk head pivot arm bolt aligned parallel to the pivot axis.

2. The antenna mount of claim 1, further including a mounting bracket coupled to the pivot base; the mounting bracket provided with mounting grooves aligned parallel to the pivot axis.

3. The antenna mount of claim 1, further including an elevation plate coupled to the pivot saddle; the elevation plate provided with an antenna mounting surface.

4. The antenna mount of claim 1, wherein the conical countersunk pivot arm bolt hole and one of the conical countersunk pivot connection bolt holes are provided in the pivot saddle each with a countersink aligned with a common plane.

5. The antenna mount of claim 1, wherein the pivot base is provided with a partially circular cross section proximate the pivot slot, about the pivot axis; and washers with a circle arc segment face seat against the partially circular cross section on a front side and a back side of the pivot slot.

6. The antenna mount of claim 1, wherein the dual opposing conical countersunk head pivot connection bolts are coupled to opposing ends of a pivot connection hole extending through the pivot base.

7. The antenna mount of claim 6, wherein the dual opposing conical countersunk head pivot connection bolts are coupled to the pivot connection hole via threading.

8. An antenna mount, comprising:

a pivot base;

a pivot saddle rotatably coupled to the pivot base by a pivot connection provided between two pivot arm connections;

the pivot connection provided with dual opposing conical countersunk head pivot connection bolts seated within conical countersunk pivot connection bolt holes of the pivot saddle, the conical countersunk head pivot connection bolts extending through the conical countersunk pivot connection bolt holes of the pivot saddle to couple with the pivot base about a pivot axis;

each of the pivot arm connections provided as an extension bolt extending between the pivot base and the pivot saddle; a first end of the extension bolt passing through a pivot slot of the pivot base; a second end of the extension bolt coupled to the pivot saddle by a conical countersunk head pivot arm bolt extending through a conical countersunk pivot arm bolt hole of the pivot saddle;

the conical countersunk head pivot arm bolt aligned parallel to the pivot axis.

9. The antenna mount of claim 8, further including a mounting bracket coupled to the pivot base; the mounting bracket provided with mounting grooves aligned parallel to the pivot axis.

10. The antenna mount of claim 8, further including an elevation plate coupled to the pivot saddle; the elevation plate provided with an antenna mounting surface.

11. The antenna mount of claim 8, wherein the conical countersunk pivot arm bolt hole and the conical countersunk pivot connection bolt holes are provided in the pivot saddle each with a countersink aligned within a common plane.

12. The antenna mount of claim 8, wherein the pivot base is provided with a partially circular cross section, proximate the pivot slot, about the pivot axis; and washers with a circle arc segment face seat against the partially circular cross section on a front side and a back side of the pivot slot.

13. The antenna mount of claim 8, wherein the dual opposing conical countersunk head pivot connection bolts are coupled to opposing ends of a pivot connection hole extending through the pivot base.

* * * * *